US012527422B2

(12) United States Patent
Schingarjow

(10) Patent No.: US 12,527,422 B2
(45) Date of Patent: Jan. 20, 2026

(54) COVER DEVICE

(71) Applicant: Sanders-Kauffmann GmbH, Bramsche (DE)

(72) Inventor: Swetlana Schingarjow, Lengerich (DE)

(73) Assignee: Sanders-Kauffmann GmbH, Bramsche (DE)

( * ) Notice: Subject to any disclaimer, the term of this patent is extended or adjusted under 35 U.S.C. 154(b) by 0 days.

(21) Appl. No.: 18/836,623

(22) PCT Filed: Feb. 7, 2023

(86) PCT No.: PCT/EP2023/052993
§ 371 (c)(1),
(2) Date: Aug. 7, 2024

(87) PCT Pub. No.: WO2023/148403
PCT Pub. Date: Aug. 10, 2023

(65) Prior Publication Data

US 2025/0160547 A1 May 22, 2025

(30) Foreign Application Priority Data

Feb. 7, 2022 (EP) ..... 22155476

(51) Int. Cl.
*A47G 9/02* (2006.01)

(52) U.S. Cl.
CPC ..... *A47G 9/0207* (2013.01)

(58) Field of Classification Search
CPC ... A47G 9/0207; A47G 9/0215; A47G 9/0223
See application file for complete search history.

(56) References Cited

U.S. PATENT DOCUMENTS 1,421,906 A * 7/1922 Calef ..... A47G 9/0207 5/502
2,399,235 A * 4/1946 Leslie ..... A47G 9/0207 24/72.5
5,528,781 A * 6/1996 Suzuki ..... A47G 9/0207 5/413 R
2009/0297798 A1* 12/2009 Tsai ..... A47G 9/086 5/413 R (Continued)

FOREIGN PATENT DOCUMENTS

WO 9218036 A1 10/1992

*Primary Examiner* — Richard G Davis
(74) *Attorney, Agent, or Firm* — Husch Blackwell LLP

(57) ABSTRACT

A covering device has at least three covering portions. In a cross section of the covering device, a first of the covering portions is arranged on a second of the covering portions by means of a first connecting region which is configured by a first cross-sectional end of the first covering portion. The first covering portion has a second cross-sectional end which opposes the first cross-sectional end and has a second connecting region by which the first covering portion is arranged on a third covering portion. The second connecting region of the first covering portion in cross section spaced apart from the second cross-sectional end of the first covering portion. The first covering portion is arranged by the second connecting region on a cross-sectional end of the third covering portion which is equal to the first cross-sectional end of the first covering portion.

23 Claims, 6 Drawing Sheets

(56) References Cited

U.S. PATENT DOCUMENTS

| | | | | |
|---|---|---|---|---|
| 2013/0136892 | A1* | 5/2013 | Ozawa | B68G 11/03 428/114 |
| 2014/0250596 | A1* | 9/2014 | De La Place | A47G 9/0207 5/482 |

* cited by examiner

COVER DEVICE

CROSS REFERENCE

This application claims priority to PCT Application No. PCT/EP2023/052993, filed Feb. 7, 2023, which itself claims priority to EU Patent Application No. 22155476.9, filed Feb. 7, 2022, the entireties of both of which are hereby incorporated by reference.

FIELD OF THE INVENTION

The invention relates to a covering device, in particular a cover. The covering device comprises at least three covering portions. A first of the covering portions has a first connecting region. In a cross section of the covering device, the first covering portion is arranged on a second of the covering portions by means of the first connecting region. The first connecting region is configured by a first cross-sectional end of the first covering portion or coincides therewith. The first covering portion has in cross section a second cross-sectional end which opposes the first cross-sectional end. Moreover, the first covering portion has a second connecting region by which the first covering portion is arranged on a third covering portion element.

BACKGROUND OF THE INVENTION

Such covering devices serve, in particular, for covering the bodies of humans or animals. Frequently, the known covering devices provide inadequate ventilation. For improving the ventilation, DE 20221416 U1 discloses a cover with a plurality of ventilation openings. This cover firstly has the drawback, however, that in the case of low ambient temperatures the heat of the body is dissipated to the environment via the ventilation openings, i.e. an inadequate insulation is provided and the body cools down. Secondly, the cover has the further drawback that in the case of high ambient temperatures the ventilation openings are inadequate for the removal of heat, and the body overheats.

Moreover, in the covering device of the invention the second connecting region of the first covering portion in cross section is arranged spaced apart from the second cross-sectional end of the first covering portion. Such a covering device is known from US 2014/0250596 A1 which discloses a bed cover with through-passages for heat between insulating portions. The above-described drawbacks also occur to a significant degree in this bed cover.

BRIEF SUMMARY OF THE INVENTION

It is the object of the present invention to provide a covering device which avoids the aforementioned drawbacks.

According to the invention, the first covering portion is arranged by means of the second connecting region on a cross-sectional end of the third covering portion. The cross-sectional end of the third covering portion according to the invention is equal to the first cross-sectional end of the first covering portion.

The covering device is preferably a duvet, in particular a grid-patterned cover, preferably a quilted cover or down-filled cover. The covering device serves, in particular, for covering, for heating and for ventilating a human body. The covering device has, in particular, a width of at least 0.8 m and a length of at least 0.8 m. During use, the covering device is preferably located inside a quilt cover and on the body. The covering device is preferably configured at least substantially from textiles. The covering device, in particular, is configured to be dimensionally stable and flexible in order to be able to adapt to the body. The following features relate, in particular, to the covering device while it is positioned spread out on a planar surface and the respective components are stretched.

The covering portions of the covering device, or at least a plurality thereof, are configured, in particular, to coincide at least substantially. The cross section through the covering device runs at right-angles to the main direction of extent and/or to the longitudinal direction of the covering device. Alternatively, the cross section runs in the main direction of extent or longitudinal direction.

The first covering portion is configured in cross section, in particular at least when external forces are absent, at least substantially mirror-symmetrically to a plane which intersects the covering device centrally and in a planar manner and which is arranged at right-angles to the cross-sectional plane. The cross-sectional ends of the first covering portion are in cross section, in particular, the points at which the contour of the covering portion intersects the plane. The first covering portion or the main part, such as an insulating part thereof, is configured to be in particular elongated in cross section, preferably in the shape of a convex lens, wherein the longitudinal ends or the corners of the contour of the covering portion form the cross-sectional ends. The cross-sectional ends have a greater spacing from one another than any other regions of the first covering portion in cross section.

The first covering portion directly adjoins the second or third covering portion by means of the connecting regions. The first covering portion is connected, in particular, permanently to the further covering portions, i.e. it cannot be detached in a non-destructive manner from the further covering portions. Alternatively, the first covering portion is releasably connected to at least one of the further covering portions. As the second connecting region of the first covering portion in cross section is spaced apart from the second cross-sectional end of the first covering portion, the third covering portion does not adjoin the second cross-sectional end of the first covering portion but, in particular, adjoins one of the main surfaces of the first covering portion between the cross-sectional ends of the first covering portion. The first covering portion thus at least partially protrudes over the third covering portion or overlaps the third covering portion.

During use, depending on the size of the body to be covered, in cross section the covering device is located in an at least substantially curved manner on the body/around the body. If the covering device is used such that the second connecting region faces the body to be covered, the second cross-sectional end protrudes outwardly away from the third covering portion on the side of the covering device facing away from the body. As a result, the insulating effect of the first covering portion is reduced and consequently the covering device is suitable for higher ambient temperatures. If the covering device is used the other way around, wherein the second connecting region of the first covering portion faces away from the body, due to the curved shape the third covering portion lies directly on the first covering portion and overlaps this first covering portion. This results in a greater insulating action, whereby the same cover is also suitable for lower ambient temperatures. This produces a covering device which in contrast to the previously known covering devices provides an appropriate insulating action for a wide range of ambient temperatures.

The insulating action in the first-mentioned case of use can be reduced in a particularly effective manner by the configuration according to the invention.

Preferably, the spacing of the second connecting region from the second cross-sectional end of the first covering portion is at least in particular at least $$\frac{1}{20},$$

in particular at least $$\frac{1}{10},$$

preferably at least $$\frac{1}{7},$$

particularly preferably at least $$\frac{1}{5}$$

of the spacing of the first cross-sectional end from the second cross-sectional end or a connecting seam, which is placed between the cross-sectional ends, from the second cross-sectional end. The spacings are to be understood such that they correspond to the distance at least to be covered along the contour of the first covering portion. The insulating action can be varied in a particularly wide-ranging manner by the aforementioned spacings.

In an advantageous embodiment of the invention, at least one of the covering portions has an insulating portion. In particular, each covering portion has exactly one insulating portion. The insulating portion comprises a sleeve which encases a hollow space in which an insulating means is arranged. The sleeve is preferably configured from, in particular, a thin textile, preferably a woven fabric. The insulating means is preferably natural fibres or synthetic fibres, natural hair or animal hair or down. The sleeve is adjacent to the surroundings. Preferably, all of the covering portions are configured in such a manner.

The at least one covering portion has, in particular, at least one end seam for forming at least one of the cross-sectional ends which extends in a direction which is at an angle, in particular at right-angles, to the cross-sectional plane. The end seam runs, in particular, through one of the cross-sectional ends in cross section. The end seam is configured, in particular, such that it connects an upper part of the sleeve to a lower part of the sleeve. Preferably, at least one end seam runs through each cross-sectional end. The at least one seam is advantageously independent of the presence of an insulating means. Covering portions which are constructed in such a manner permit a particularly effective insulating action.

Preferably, the insulating portions of the various covering portions have at least partially different widths. In particular, the spacing between the first cross-sectional end of the first covering portion and the second cross-sectional end of the first covering portion deviates from the spacing between a first cross-sectional end of one of the other covering portions and a second cross-sectional end of the other covering portion. Alternatively or additionally, in particular, the spacing between the second cross-sectional end of the first covering portion and a through-passage element of the first covering portion deviates from the spacing between the second cross-sectional end of the other covering portion and a through-passage element of the other covering portion. The second cross-sectional ends are arranged facing away from the through-passage element. The covering device can be optimally adapted to specific bodies by the variable spacings or widths of the insulating portions. In particular, as a result, the covering device can be configured for covering two bodies. Particularly preferably, the predefined spacing in the outermost of the covering portions in cross section is greater than in the adjacent covering portion. Alternatively or additionally, the spacings at least partially increase outwardly. As a result, the ventilating effect and the insulating effect can be customized as required.

The sleeve preferably has at least one connecting seam for connecting the first covering portion to the third covering portion. The connecting seam extends in a direction which is at an angle, in particular at right-angles, to the cross-sectional plane and/or parallel to the end seam. The connecting seam runs, in particular, through the second connecting region in cross section. The connecting seam is particularly preferably the only means by which the first covering portion is connected to the third covering portion. Due to the connecting seam, the covering device according to the invention can be produced with reinforced means and thus is particularly durable.

Preferably, the first covering portion has a plurality of second connecting regions. The second connecting regions of the first covering portion are spaced apart from one another in a direction which is at an angle, in particular at right-angles, to the cross-sectional plane. Adjacent regions of the second connecting regions of the first covering portion define a through-passage arranged therebetween. In this case, the first and the third covering portion are connected (only) intermittently to one another. In particular, an insulating portion of the first covering portion is connected intermittently to an insulating portion of the third covering portion. The number of second connecting regions which are spaced apart in the aforementioned direction is preferably at least three, particularly preferably at least five, and/or preferably at least or exactly corresponds to a number of transverse seams of the first and/or third covering portion which run parallel to the cross-sectional plane and in each case define a hollow space or form a defined area of the respective covering portion. The first covering portion and the third covering portion are preferably not connected together between the adjacent second connecting regions and particularly preferably no other material is present, whereby the through-passage has a maximum ventilating action. Alternatively, the through-passage is preferably formed or spanned by a material which has a greater ventilating action than the insulating portion of the first covering portion. The advantage of the intermittent connection of the covering portions is that relative to the known covering devices no further constituent parts are required in order to achieve a substantially variable insulating action.

Alternatively to the intermittent connection of the first and third covering portions, the second connecting region in cross section extends at least substantially as far in the aforementioned direction as the first and/or the third covering portion extend/extends in the same direction. In this case, the covering portions are connected together without gaps and a greater stability is achieved. "Without gaps" in this context is to be understood to mean that a coarse woven fabric or ventilation openings in one of the covering portions do not constitute gaps in the connection.

The third covering portion preferably has a through-passage element which extends as far as the second connecting region of the first covering portion. The through-passage element is arranged, in particular, on the insulating portion of the third covering element and particularly preferably extends from the insulating portion of the third covering portion as far as the insulating portion of the first covering portion. Thus the insulating portions can be fully spaced apart from one another and set a ventilating action which is fixed in the aforementioned direction. The through-passage element preferably has a higher air permeability per pressure drop than the insulating portion of the first or third covering element. The through-passage element is preferably formed from a textile, preferably a woven fabric, with ventilation openings such as for example meshwork. Alternatively or additionally, the through-passage element is preferably formed from the woven fabric which at least also forms the sleeve. As a result, a particularly extensive ventilating action or a greater reliability can be achieved by the use of tried and tested materials.

Preferably, the spacing of the insulating portion of the third covering portion from the second connecting region of the first covering portion is at most as large as the spacing of the second connecting region from the second cross-sectional end of the first covering portion. Particularly preferably, the spacings are at least substantially equally large. The spacing of the insulating portion of the third covering portion from the second connecting region is understood to mean in this case the distance along the contour of the through-passage element between the first covering portion and the insulating portion of the third covering portion in cross section. In the case of low ambient temperatures, it can be ensured by this configuration that the insulating portions of the covering portions overlap with one another or at least adjoin one another and thus no heat can escape inadvertently through the through-passage element.

In an advantageous embodiment of the invention, the covering device has a plurality of groups of, in each case three, covering portions which are configured according to the first, second and third covering portion. In particular, the covering device has at least four such groups. It is to be understood that the groups differ from one another in at least one of the three associated covering portions. Individual covering portions can form together a plurality of groups (at the same time). As a result, four covering portions can form two groups and six covering portions can form four groups. The above-described effects can be achieved particularly extensively and uniformly over the entire surface of the covering device by means of this configuration of the covering device.

Preferably, a plurality, in particular all, of the groups, have a matching orientation in cross section. This means that the groups are not mirrored relative to one another but are offset to one another and oriented in the same manner. As a result, a particularly uniform ventilating action can be achieved. Alternatively, at least two of the groups, in particular the entire covering device, is/are configured mirror-symmetrically. When the covering device is used in such a manner that the mirror plane vertically intersects the body to be covered, this has the result that both sides of the body are ventilated equally.

In particular, the covering device in any case has a plurality of through-passage elements which are spaced apart in cross section. The ratio of the number of through-passage elements to the number of insulating portions is preferably $\geq 0.5$ and $\leq 1$. Preferably, at least $$\frac{2}{3}$$

of the covering portions has a through-passage element.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
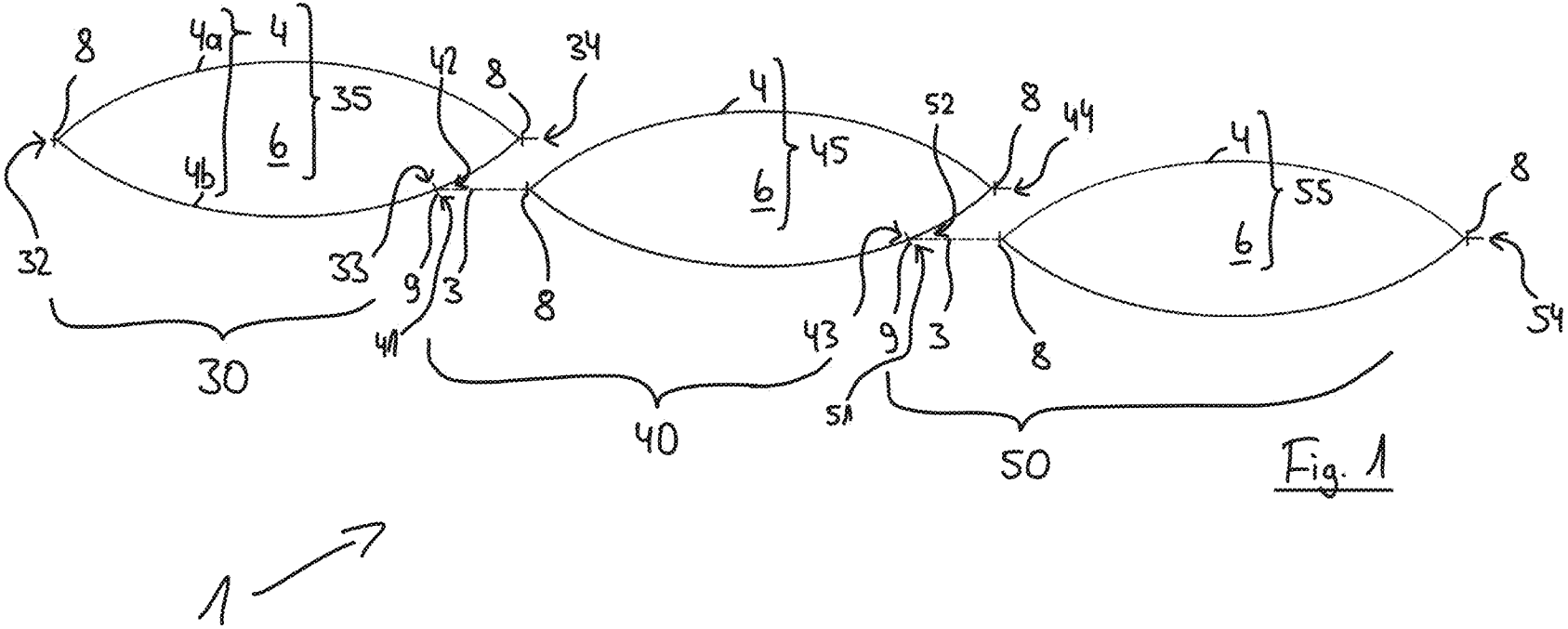
FIG. 1 shows a cross section of a first covering device according to the invention.

The features of the exemplary embodiments according to the invention explained hereinafter can also form the subject matter of the invention individually or in other combinations from those shown or described, but always at least in combination with the features of Claim 1. If expedient, parts which are functionally the same are provided with identical reference numerals.

The first covering device 1 according to the invention has three covering portions 30, 40, 50. In the cross section according to FIG. 1, a first of the covering portions 40 is arranged with a first connecting region 41 on a second of the covering portions 30. The first connecting region 41 is configured from a first cross-sectional end 42 of the first covering portion 40. The first covering portion 40 also has a second cross-sectional end 44 which opposes the first cross-sectional end 42. The first covering portion 40 also has a second connecting region 43 by which the first covering portion 40 is arranged on a third of the covering portions 50. The second connecting region 43 is arranged spaced apart from the second cross-sectional end 44. The second covering portion 30 has a second cross-sectional end 34 and a second connecting region 33 which correspond to the second cross-sectional end 44 and the second connecting region 43 of the first covering portion 40, wherein the first cross-sectional end 32 of the second covering portion 30 is configured differently from the first cross-sectional end 42 of the first covering portion. The third covering portion 50 has a first cross-sectional end 52, a second cross-sectional end 54 and a first connecting region 51 which corresponds to the first cross-sectional end 42, the second cross-sectional end 44 and the first connecting region 41 of the first covering portion 40. The further covering devices 1 according to the invention also exhibit this construction.

Each of the covering portions 30, 40, 50 shown has an insulating portion 35, 45, 55. Each insulating portion 35, 45, 55 comprises a sleeve 4 made of an upper part 4*a* and a lower part 4*b*. The sleeve 4 encases a hollow space 6 having an insulating means. The upper part 4*a* and the lower part 4*b* of the insulating portions 35, 45, 55 are connected together by means of end seams 8 in the region of the cross-sectional ends 34, 44, 54 of the covering portions 30, 40, 50 shown.

The first covering portion 40 has a through-passage element 3, as does the third covering portion 50. This through-passage element is arranged in each case by means of an end seam 8 on the insulating portion 45, 55 and extends as far as the second connecting region 33, 43 of the second covering portion 30 or the first covering portion 40. The through-passage elements 3 have ventilation openings. The spacing of the second connecting region 43 from the cross-sectional end 44, measured along the contour of the sleeve 4 of the first covering portion 40, corresponds to the length of the through-passage element 3 which can be measured in cross section. The spacing of the second connecting region 43 from the second cross-sectional end 44 is at least $$\frac{1}{5}$$

of the spacing of the first cross-sectional end 42 or the end seam 8, which connects the through-passage element 3 to the insulating portion 45, from the second cross-sectional end 44 along the contour of the sleeve 4. That described above also applies to the second covering portion 30 and the first covering portion 40.

Figure 2:
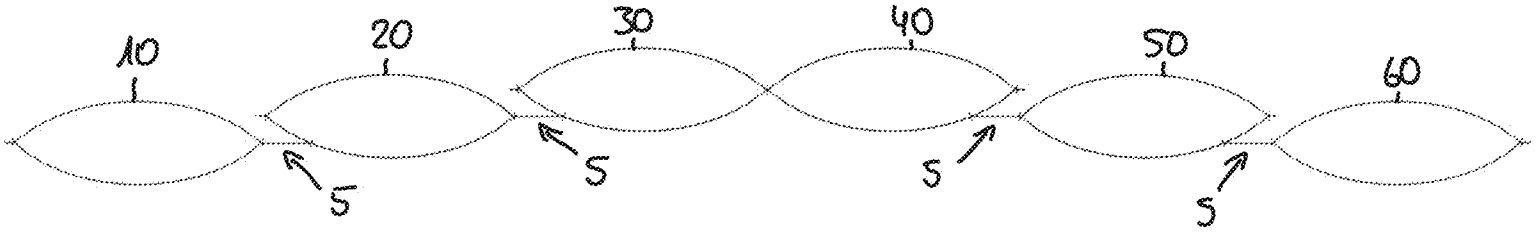
FIG. 2 shows a cross section of a second covering device according to the invention.
Figures 4, 5:
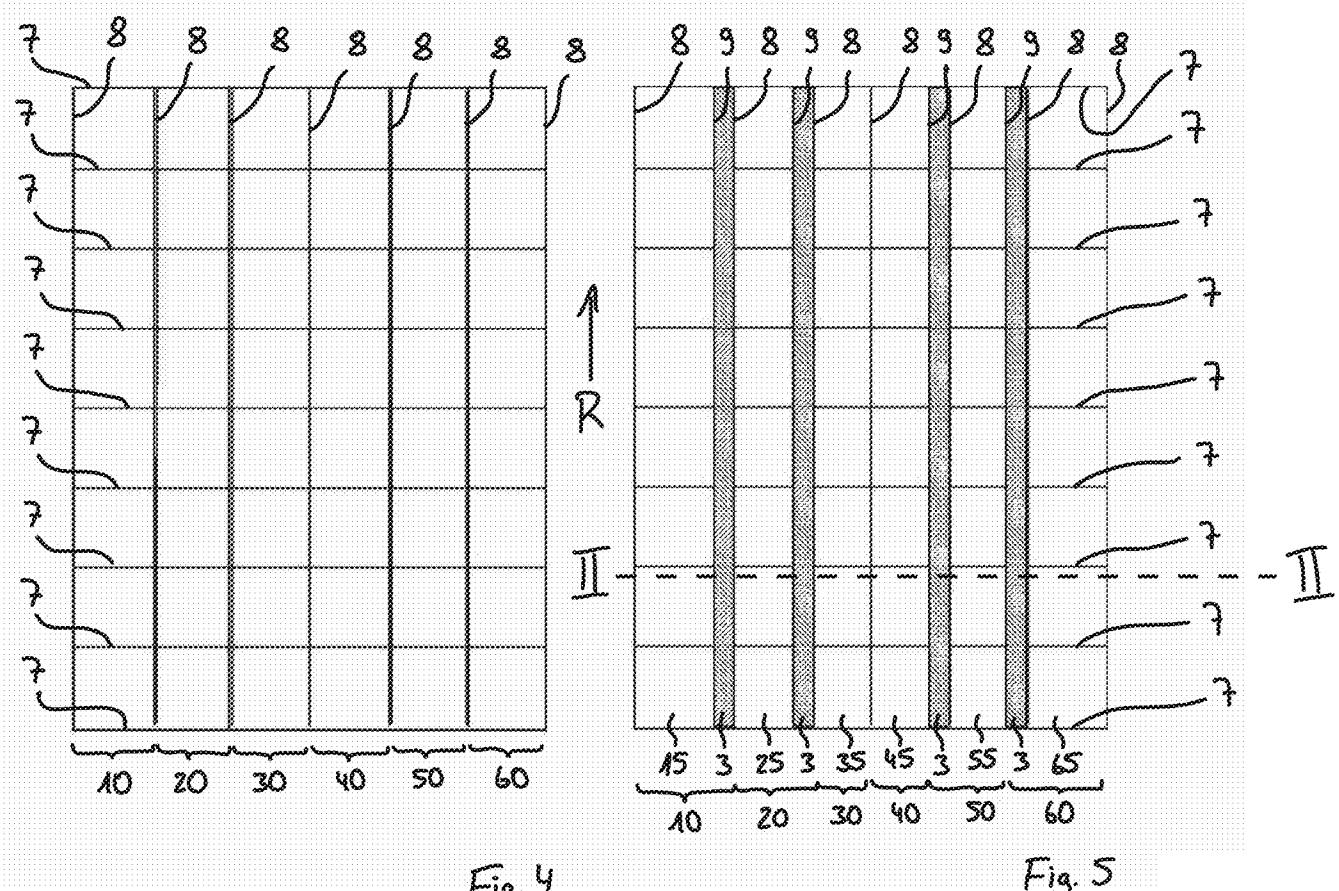
FIG. 4 shows a plan view of a fourth covering device according to the invention in a first configuration.
FIG. 5 shows a plan view of the fourth covering device according to the invention in a second configuration.

The covering device 1 according to FIG. 2 comprises six covering portions 10, 20, 30, 40, 50, 60 and is constructed mirror-symmetrically from two covering devices 1 connected together according to FIG. 1. Each through-passage element 3 forms a through-passage 5 for air. The covering device 1 according to FIGS. 4 to 7 is similar at least to the covering device 1 according to FIG. 2, the cross-sectional plane thereof being indicated schematically by the cutting line II in FIG. 5. FIG. 5 shows the covering device in the configuration shown in FIG. 2 from below, so that the four through-passage elements 3 are visible. FIG. 4 shows the covering device 1 in a configuration in which the covering portions 10, 20, 30, 40, 50, 60 are present as closed relative to one another and the through-passage elements 3 are located between the covering portions 10, 20, 30, 40, 50, 60. In addition to the end seams 8 and the connecting seams 9, FIGS. 4 and 5 additionally show transverse seams 7 which separate the different hollow spaces 6 of the covering portions 10, 20, 30, 40, 50, 60 from one another. The end seams 8 and the connecting seams 9 extend in a direction R at right-angles to the cross-sectional plane. The second connecting regions 43 of the covering portions 20, 30, 40, 50 extend as far in the direction R as the covering portions 20, 30, 40, 50 themselves.

Figure 6:
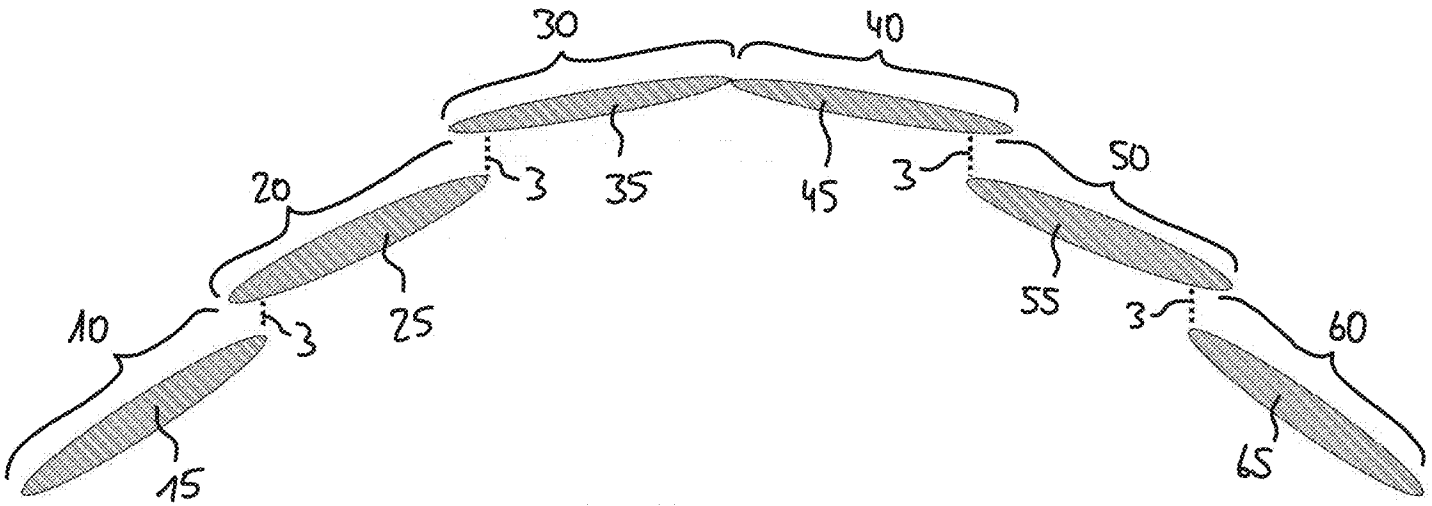
FIG. 6 shows a cross section of the fourth covering device according to the invention in the second configuration during use.
Figure 7:
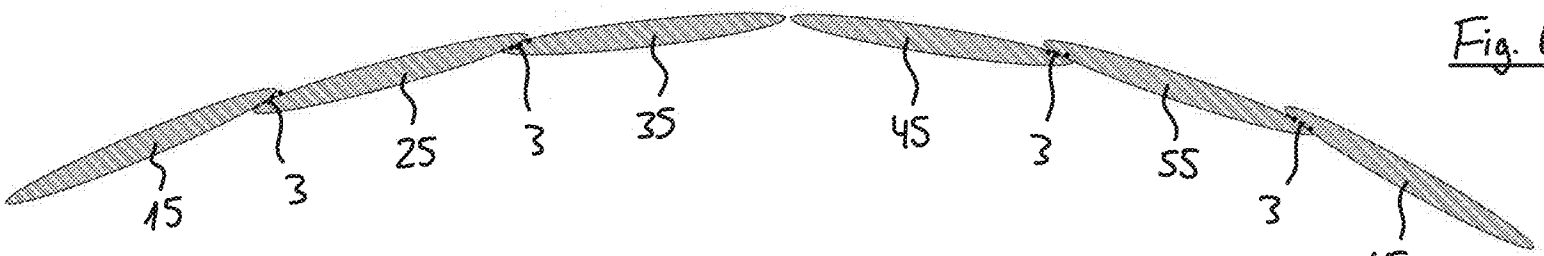
FIG. 7 shows a cross section of the fourth covering device according to the invention in the first configuration during use.
Figure 8:
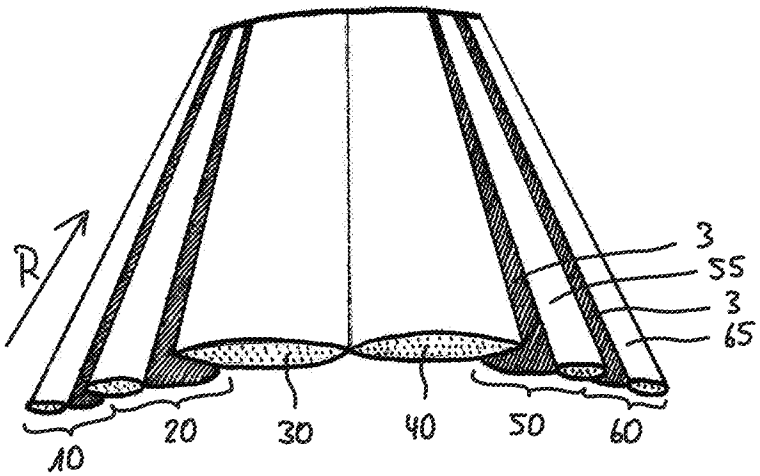
FIG. 8 shows a perspective sectional view of a fifth covering device according to the invention.

FIGS. 6 to 8 illustrate the advantage of the covering device 1 according to the invention. If the covering device 1 is used such that the through-passage elements 3 face the body to be covered, not shown, the insulating portions 15, 25, 55, 65 of the outer covering portions 10, 20, 50, 60 move away from one another due to gravitational force, and the through-passage elements 3 are stretched.

As a result, through-passages 5 which bring about a ventilation of the body are produced between the insulating portions 15, 25, 35, 45, 55, 65, whereby the covering device 1 is suitable, in particular, for high ambient temperatures. If the covering device 1 is used according to FIG. 7, however, such that the through-passage elements 3 face away from the body to be covered, the through-passage elements 3 produce an arrangement of the insulating portions 15, 25, 35, 45, 55, 65 without gaps relative to one another and thereby an improved insulating effect, whereby the covering device 1 is suitable, in particular, for lower ambient temperatures.

Figure 3:
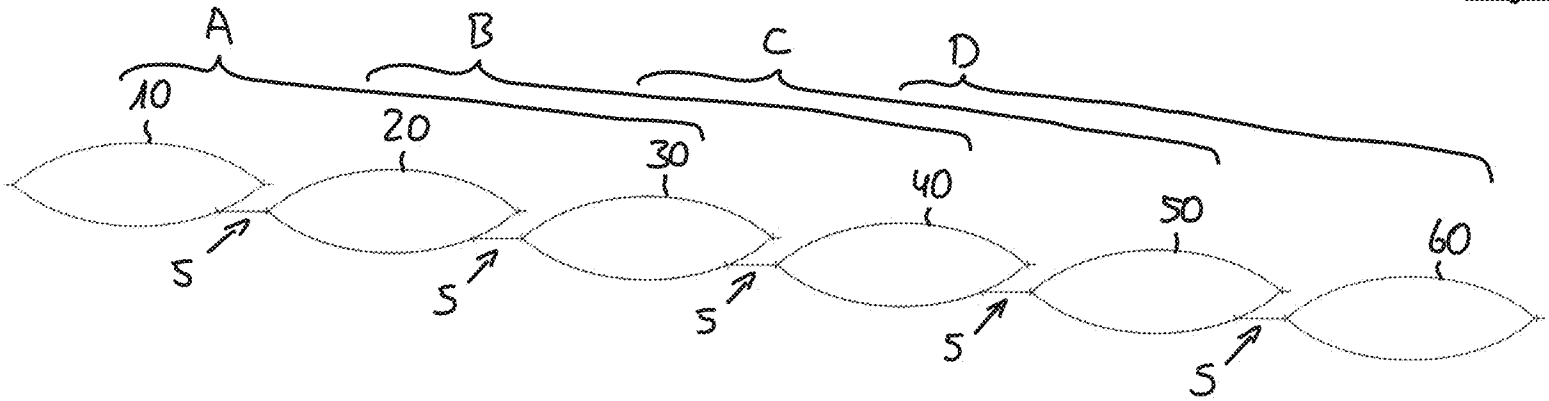
FIG. 3 shows a cross section of a third covering device according to the invention.

The covering device 1 according to FIG. 3, in contrast to that according to FIG. 2, is not configured mirror-symmetrically. Rather, it has four groups A, B, C, D of covering portions 10, 20, 30, 40, 50, 60 which in cross section have a matching orientation.

Figure 10:
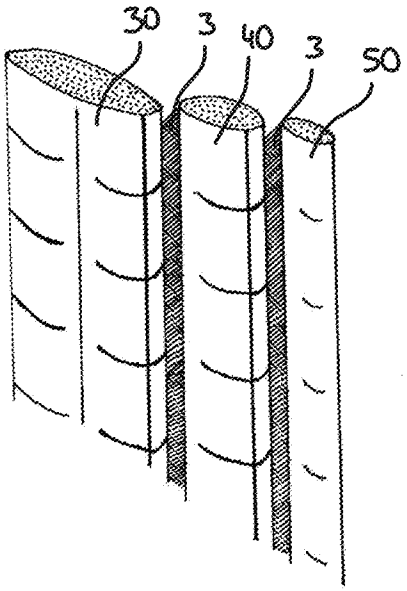
FIG. 10 shows a perspective sectional view of a seventh covering device according to the invention.
Figure 9:
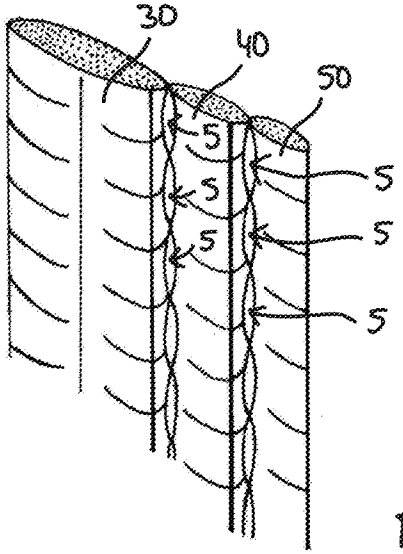
FIG. 9 shows a perspective sectional view of a sixth covering device according to the invention.

The covering device 1 according to FIG. 10 is similar to the covering device 1 according to FIG. 1, wherein the through-passage elements 3 and the insulating means are shown schematically, as in FIG. 8. FIG. 9 shows an alternatively configured covering device 1 in which the first covering portion 40 has a plurality of second connecting regions 43 offset in the direction R. Adjacent second connecting regions 43 define a through-passage 5 arranged therebetween. The number of second connecting regions 43 corresponds to the number of transverse seams 7.

The invention claimed is:

1. A covering device comprising:

at least three covering portions, wherein in a cross section of the covering device a first of the covering portions is arranged on a second of the covering portions by first connecting region which is configured by a first cross-sectional end of the first covering portion, and has a second cross-sectional end which opposes the first cross-sectional end and has a second connecting region by which the first covering portion is arranged on a third covering portion, wherein the second connecting region of the first covering portion in cross section is arranged spaced apart from the second cross-sectional end of the first covering portion, wherein the first covering portion is arranged by the second connecting region on a cross-sectional end of the third covering portion which is equal to the first cross-sectional end of the first covering portion.

2. The covering device according to claim 1, wherein the spacing of the second connecting region from the second cross-sectional end of the first covering portion is at least 1/20 of the spacing of the first cross-sectional end from the second cross-sectional end.

3. The covering device according to claim 1, wherein at least one of the covering portions has an insulating portion with a sleeve which encases at least one hollow space having an insulating means.

4. The covering device according to claim 3, that wherein a spacing between the first cross-sectional end of the first covering portion and the second cross-sectional end of the first covering portion deviates from a spacing between a first cross-sectional end of one of the other covering portions and a second cross-sectional end of the other covering portion, or the spacing between the second cross-sectional end of the first covering portion and a through-passage element of the first covering portion deviates from the spacing between the second cross-sectional end of the other covering portion and a through-passage element of the other covering portion.

5. The covering device according to claim 4, wherein the spacing in the outermost of the covering portions in cross section is greater than in the adjacent covering portion.

6. The covering device according to claim 3, wherein the sleeve has at least one connecting seam extending in a direction (R) which is at an angle to the cross-sectional plane for connecting the first covering portion to the third covering portion.

7. The covering device according to claim 6, wherein the at least one connecting seam is at right angle to the cross-sectional plane for connecting the first covering portion to the third covering portion.

8. The covering device according to claim 3, wherein the first covering portion has a plurality of second connecting regions which are spaced apart from one another in a direction (R) which is at an angle to the cross-sectional plane, wherein adjacent second connecting regions define a through-passage arranged therebetween.

9. The covering device according to claim 8, wherein the first covering portion has at least three second connecting regions which are spaced apart from one another in the direction (R).

10. The covering device according to claim 9, wherein the first covering portion has as many second connecting regions as the insulating portion of the first covering portion has transverse seams running parallel to the cross-sectional plane.

11. The covering device according to claim 3, wherein at least one of the covering portions has at least one end seam which extends in a direction (R) which is at a right-angle to the cross-sectional plane for forming at least one of the cross-sectional ends.

12. The covering device according to claim 1, wherein the second connecting region in cross section extends in a direction (R) which is at an angle to the cross-sectional plane at least substantially as far as the first and/or the third covering portion extend in the direction (R).

13. The covering device according to claim 1, wherein the third covering portion has a through-passage element which extends as far as the second connecting region of the first covering portion and which is arranged on an insulating portion, which has a sleeve encasing a hollow space having an insulating means, of the third covering portion.

14. The covering device according to claim 13, wherein the through-passage element has a higher permeability per pressure drop than the insulating portion of the third covering portion.

15. The covering device according to claim 13, wherein the through-passage element is formed from a textile woven fabric.

16. The covering device according to claim 15, wherein the through-passage element is formed from a textile woven fabric with through-openings, and is configured from meshwork or the same textile material from which the sleeve is at least substantially configured.

17. The covering device according to claim 13, wherein the spacing of the insulating portion of the third covering portion from the second connecting region is at most as large as the spacing of the second connecting region from the second cross-sectional end of the first covering portion.

18. The covering device according to claim 17, wherein the spacing of the insulating portion of the third covering portion from the second connecting region is at least substantially equally as large as the spacing of the second connecting region from the second cross-sectional end of the first covering portion.

19. The covering device according to claim 1, further including a plurality of groups (A, B, C, D) of three covering portions which are configured according to the first, the second and the third covering portion.

20. The covering device according to claim 19, wherein a plurality of the groups (A, B, C, D) have a matching orientation in cross section.

21. The covering device according to claim 20, wherein all of the groups (A, B, C, D) have a matching orientation in cross section.

22. The covering device according to claim 19, further including a mirror-symmetrical configuration of at least two groups (A, B, C, D) of covering portions.

23. The covering device according to claim 19, wherein there are at least four groups.

* * * * *